US005167348A

United States Patent [19]

Okami et al.

[11] Patent Number: 5,167,348

[45] Date of Patent: Dec. 1, 1992

[54] TUBE SQUEEZER

[76] Inventors: Alvin S. Okami, 744 Kohou St., Honolulu, Hi. 96817; Denny W. Kwock, 2756 Woodlawn Dr. Ste. 6-200, Honolulu, Hi. 96822-1856

[21] Appl. No.: 629,170

[22] Filed: Dec. 19, 1990

Related U.S. Application Data

[63] Continuation of Ser. No. 459,293, Dec. 29, 1989, abandoned.

[51] Int. Cl.[5] ..... B65D 35/28

[52] U.S. Cl. ..... 222/103; 222/93; 222/102; 222/105; 248/108; 248/314

[58] Field of Search ..... 222/92, 93, 99–106; 248/108, 314, 316.8, 309.1; 24/523, 530, 17 B

[56] References Cited

U.S. PATENT DOCUMENTS

| | | | |
|---|---|---|---|
| 1,386,966 | 8/1921 | Slade . | |
| 1,479,101 | 1/1924 | Legendre . | |
| 1,773,104 | 8/1930 | Johnson . | |
| 1,983,462 | 12/1934 | Johnson . | |
| 1,998,232 | 4/1935 | Gould | 248/108 |
| 2,037,138 | 4/1936 | McConnon | 222/102 X |
| 2,129,627 | 9/1938 | Sands et al. . | |
| 2,196,786 | 4/1940 | Wahl | 248/314 |
| 2,471,825 | 5/1949 | Long | 248/314 |
| 2,502,081 | 3/1950 | Flynn et al. . | |
| 2,551,176 | 5/1951 | Smith . | |
| 2,901,147 | 8/1959 | Bond | 222/102 |
| 3,081,056 | 3/1963 | Young et al. | 248/314 X |
| 3,085,716 | 4/1963 | Trattler | 222/93 |
| 3,257,039 | 6/1966 | Trutza | 222/102 |
| 3,262,605 | 7/1966 | Madden . | |
| 3,281,016 | 3/1965 | Thompson . | |
| 4,159,787 | 7/1979 | Wright . | |
| 4,359,173 | 11/1982 | Williams | 222/100 |
| 4,448,333 | 5/1984 | Ferrari . | |
| 4,576,314 | 3/1986 | Elias et al. . | |
| 4,599,758 | 7/1986 | Stiles . | |
| 4,672,703 | 6/1987 | Frazier | 248/314 X |
| 4,778,082 | 10/1988 | Vitelle . | |

FOREIGN PATENT DOCUMENTS

| | | | |
|---|---|---|---|
| 466853 | 9/1928 | Fed. Rep. of Germany | 222/102 |
| 830828 | 2/1952 | Fed. Rep. of Germany | 222/102 |
| 820722 | 11/1937 | France | 222/102 |
| 444344 | 1/1949 | Italy | 222/102 |
| 446267 | 3/1949 | Italy | 222/102 |
| 362182 | 7/1962 | Switzerland | 248/108 |
| 2071602 | 9/1981 | United Kingdom | 222/100 |

*Primary Examiner*—Kevin P. Shaver
*Attorney, Agent, or Firm*—James Creighton Wray

[57] ABSTRACT

The present invention is a tube squeezer designed to squeeze excess toothpaste, ointments, and similar materials trapped at the bottom of a collapsible tube dispenser. Two cylindrical rods positioned in parallel have notches to guide and hold two bands or O-rings at each end. The bands or O-rings provide pressure against the tube which is sandwiched between the two rods. Sliding the whole assembly up the length of the tube forces the residual contents to the top.

21 Claims, 4 Drawing Sheets

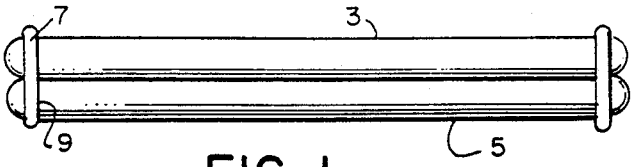
FIG. 1
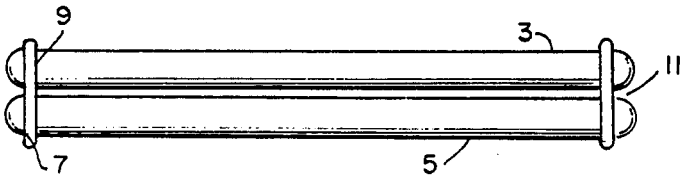
FIG. 2
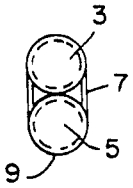
FIG. 3
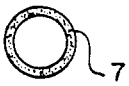
FIG. 4
FIG. 5
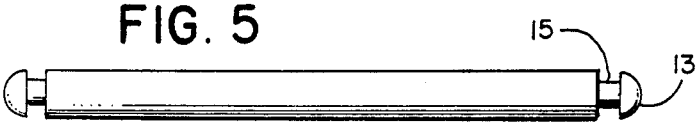
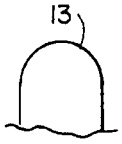
FIG. 6
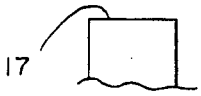
FIG. 7
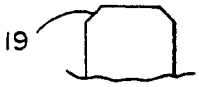
FIG. 8
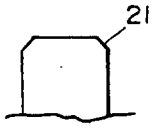
FIG. 9
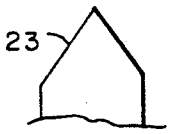
FIG. 10
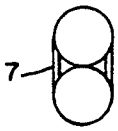
FIG. 11
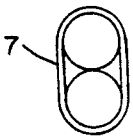
FIG. 12

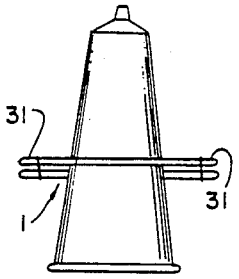
FIG. 13
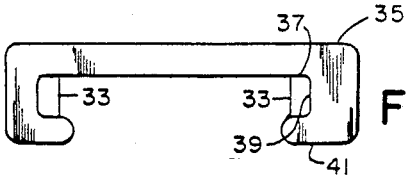
FIG. 14A
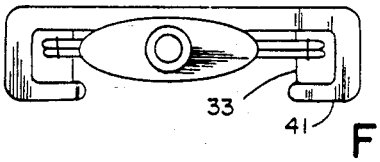
FIG. 14B
FIG. 14D
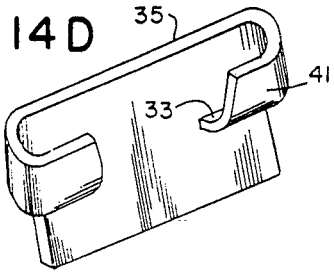
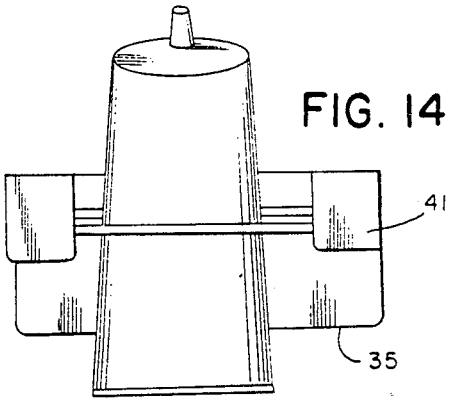
FIG. 14C
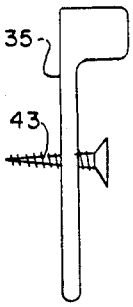
FIG. 15A
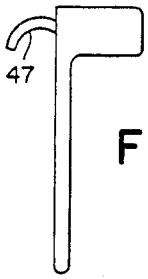
FIG. 15C
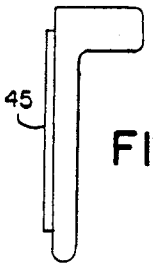
FIG. 15B
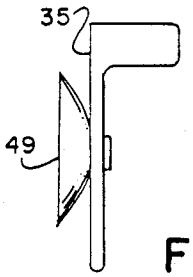
FIG. 15D

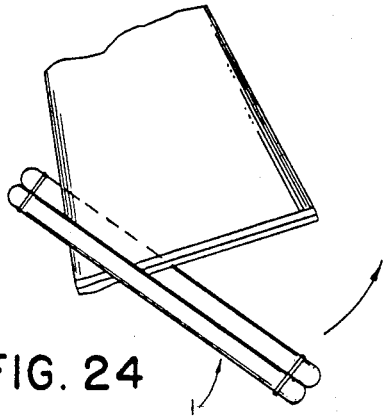
FIG. 24
FIG. 25
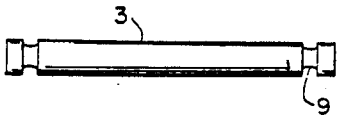
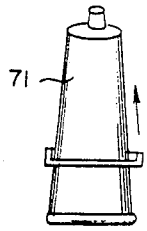
FIG. 26
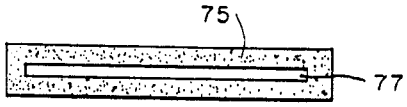
FIG. 27 (PRIOR ART)
FIG. 28A
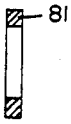
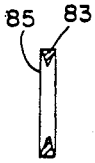
FIG. 28B
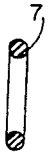
FIG. 28C
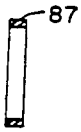
FIG. 28D

TUBE SQUEEZER

This application is a continuation of application Ser. No. 459,293, filed Dec. 29, 1989, now abandoned.

BACKGROUND OF THE INVENTION

The present invention relates to tube squeezers. The invention is a novel design for a tube squeezer. It is designed to be used with various products that come in tubes such as toothpaste, ointments, glue, etc. It is a common problem for anyone using toothpaste, or any other item dispensed by manually squeezing a plastic tube, to have the contents of the tube spread throughout the tube, and in particular to the closed bottom end of the tube when the user is attempting to dispense the contents. The problem becomes greater as the tube becomes less full. It is the object of the present invention to provide assistance to the manual dispensing of material contained within such tubing. It is a further object of the present invention to prohibit the contents of a collapsible tube dispenser from spreading to the closed end of the tube, gathering the contents towards the open end and making each successive discharge of a portion of the tubes contents as easy as the first.

A number of devices have been designed that attempt to perform the same function as the present invention. However, most prior inventions are relatively complex and contain several component parts. The present invention is simple and easy to use. Some fairly simple devices have also been designed, but these are typically of a construction having a fixed gap width through which the tube is inserted. Devices of the fixed gap width design commonly make it difficult to initially insert the closed end of a tube. Also, depending on the tube and its contents, the fixed gap width either leaves a small amount of the contents in the end which should be empty, or creates too tight a fit for the device to effectively be slid along the length of the tube. It is an object of the present invention to overcome these problems in the prior art.

The present invention works well on the new plastic type tubes. When old turnkey style squeezers (which squeezes the tube by rolling it) are used on a new plastic tube, the tube tends to unroll and the key type squeezer becomes ineffective and much more difficult to use than the present tube squeezer.

With the present invention, the tube remains flat throughout. With the key type squeezers, the tube is slowly rolled up. This may be considered unsightly and may make the tube harder to store (such as sitting in a cup).

SUMMARY OF THE INVENTION

The present invention relates to tube squeezers, and in particular to a tube squeezer of relatively simple construction that is convenient and easy to use.

It is an object of the present invention to provide effective assistance in the manual dispensing of the contents of collapsible tube dispensers. It is a further object of the present invention to provide a device with few components, having the ability to supply sufficient squeezing pressure to collapsible tube dispensers.

It is another object of the present invention to provide a device that can accommodate a range of collapsible tube thicknesses, while still providing effective squeezing pressure.

Still another object of the present invention is to provide a device which, when left on a collapsible tube dispenser, will remain in place, rather than slide back down toward the closed end of the tube.

Other objects and advantages of the present invention are apparent in the disclosure which includes the above and ongoing specification and claims and drawings.

A preferred embodiment of the invention has two cylindrical rods positioned in parallel, each with aligned notches to guide and hold two bands or 0-rings at each end. The 0-rings exert a pressure on the rods, which is in turn exerted on a tube which is sandwiched between the rods. The apparatus is rolled onto the end of a tube and then slid along the length of the tube, forcing the residual paste to the top. The rods do not roll along the tube once the tube is inserted, but rather stay in fixed relative position due to the friction forces between the rods and the 0-rings.

The basic invention consists of two identical sized cylindrical rods positioned side by side and held together at each end by two 0-rings. The rods are grooved on both ends along the diameter of the rod so that the channel will prevent the 0-ring from slipping off. The 0-rings hold the rods together, provide tension between the opposing rods, and allow the rods to rotate against each other.

The tube squeezer is used by simply slipping the end of the tube between the two rods and sliding the tube squeezer up along the length of the tube as the tube empties. The tension between opposing rods produce a squeezing action that forces the toothpaste up to the top of the tube.

Because of the narrow profile and constant tension of the present invention, it can be placed on a brand new tube where it will remain clipped on firmly. This will prevent it from being lost, i.e., in the medicine cabinet, and will insure the user will have it when the tube begins to empty. Other devices cannot be placed on until the tube is partially empty.

The use of 0-rings to provide tension has several notable advantages over other inventions designed for tube squeezing. The fact that tension is applied to the tube allows this device to work more effectively than fixed slot type inventions. The use of 0-rings will also allow the invention to easily accommodate tubes of different thicknesses, unlike devices using mechanically fixed rollers. The use of 0-rings allow the device to be compact and uncumbersome. Varying 0-rings (size, shape, and material) allow the tension to be adjusted to better suit different types of material, e.g., toothpaste vs. glue. The overall design is simple and uncumbersome.

When the device is first placed onto the bottom of the tube, the reciprocating rolling action of the squeezer helps to facilitate the operation of getting the squeezer onto the tube. The rolling action helps the user overcome the tension between the two rollers. We have found that the amount of sliding and the amount of rolling involved in this operation varies from the person to person. The variations seem to be the result of differing hand and finger positioning and how the tube is held. On many of the new plastic toothpaste tubes, the bottoms tend to uncurl, forming a wide, pliable and uneven edge. If the user attempts to place the squeezer onto the tube by pushing directly against this uneven and pliable edge, the act of placing the squeezer onto the tube can be a very difficult operation. However, the operation is much easier if the user starts at the corner of the tube (an edge that remains flat and relatively stiff and slides the squeezer on at an angle.

When the squeezer is being used, it is more of a sliding action rather than a rolling action. Again, this varies based on the user's finger and hand positioning and how the tube is held. The squeezer is very effective in performing its function. It works better with a more thorough squeeze than any other squeezer we are aware of on the market. It is also the easiest to use.

The rods could be made from various materials such as plastic, metals, wood or any other material that will maintain the required rigidity. Even hollow rods will function effectively. Of course, colors, finish, and appearance can be tailored to whatever is desired. Rods could come in a smooth finish or a course pebbled finish. The additional friction of a course or pebble finished rod may be more effective on certain types of tubes.

O-rings can be of various materials, e.g., BUNA, urethane, latex, etc. Of course, the tension on the tube squeezer can be adjusted by varying material choice and O-ring thickness and configuration. Configurations may include V-bands, square-bands, rectangular bands, etc.

The end of the rods can be made in a variety of ways.

Rounded ends allow the O-rings to easily be placed on during assembly and gives the product a rounded look.

Flat ends give the produce a different look. Beveled-flat ends allow the O-rings to be slipped on easily, but maintains a flat look.

Rounded-flat ends allow the O-ring to be slipped on easily, but maintains a flat look.

Pointed ends allows the rod to be used to pierce sealed tubes.

The rods do not necessarily have to be round, they could be octagonal, hexagonal, etc.

Combinations of end styles may be used. There could be a round end on one side and flat end on the other. A smiley face imprinted on end, etc.

An interstring design was noted when the rods were made from clear hollow acrylic. Spraying the inside of the rods with paint gave it a very unique appearance because of the clear outer layer of the rod itself. We noted that this idea could be further expanded on by possibly adding liquid, glitter, paper, printing, etc. to the inside of the rods and sealing the ends. This would allow the invention to have a unique appearance and possibly added appeal.

O-ring in this invention could be substituted by using a metal spring or string of elastic material (most likely rubber) that would run perpendicular to the central axis of the two opposing rods. The spring or rubber would be anchored on each end. Changes in design would be the following:

No groove would be required, a hole will be needed instead.

The rods would not necessarily have to be round, since they will no longer be able to roll freely.

The present invention has other, less obvious applications. It can be used to flatten other materials such as dollar bills. It makes an effective clip. It may also be used as a hand or finger exerciser, or a toy. No exact size or dimension is given for the present invention. Size can vary depending on the application for which it is manufactured.

The present invention provides a protrusion which will allow the tube to be suspended or held. It is therefore, a further object of the present invention to disclose an accessory to be used in conjunction with the tube squeezer for suspending or holding a tube. The accessory has a flat vertical surface for mounting onto a wall. The accessory may be mounted by hook, magnet, tape, screw, suction-cup, or the like. The accessory has two pockets, one at either end and toward the top of the wall-mounting surface. The pockets are both open on their adjacent sides to accommodate the tube squeezer. The open area between the two pockets is slightly wider than the distance between the two 0-rings of the tube squeezer. The holding device may also be mounted on a refrigerator door or medicine cabinet. The holding device may also be mated with a toothpaste holder or cup holder.

A preferred tube squeezer has first and second similar elongated rods. Each rod has first and second opposite ends, and each of the rods has first and second grooves respectively near the first and second ends. The first and second grooves of the second rod are spaced similarly to the first and second grooves in the first rod. First and second resilient members extend respectively between the first grooves and the second grooves. Each of the first and second resilient members has a first portion for positioning in the respective groove in the first rod and has a second portion for positioning in the respective groove in the second rod. Anchors anchor respective portions of the resilient means in the grooves. A nip is formed between adjacent longitudinal portions of the elongated rods. Enlarging the nip by inserting an end of a tube in the nip tends to stretch the first and second resilient members. The stretching of the first and second resilient members tends to return the nip towards its original condition, whereby a tube within the nip is squeezed.

In one tube squeezer the first and second grooves in the first and second ends of the first and second rods are radial grooves extending radially into the rods. Portions of the resilient members are positioned within the grooves.

Preferably, the radial grooves are diametrical grooves which extend through the rods, and end portions of the resilient members are anchored in the grooves.

Preferably anchors are enlarged opposite ends of the resilient members which extend from the rods for providing stretchability of the resilient means through the grooves and between the rods.

Preferably resilient members in that embodiment are elastic strings having knotted ends as anchor members.

Preferred tube squeezers have peripheral grooves, and resilient members are bands having opposite portions mounted in the peripheral grooves.

Preferably the peripheral grooves extend entirely around end portions of the rods.

A preferred mount has first and second opposite inward facing spaced shelves projected outwardly from a mounting surface for receiving first and second ends of the first and second rods on the mounting shelves.

Lateral and frontal walls partially surrounding outer and forward edges of the shelves for preventing lateral or forward outward movement of the rods from the shelves.

A tooth brush receiving opening is in at least one of the shelves.

A mounting means extends rearward from the mounting surface for mounting the mounting surface on a vertical surface. The mounting members may be a mounting screw, a magnet, an adhesive tape, a hook and a suction cup.

A preferred method of squeezing a product dispensing tube includes rolling a nip between first and second rods over a first corner of an end of the tube, with the rods aligned at an angle to an elongated axis of the tube, stretching first and second resilient bands on first and second opposite ends of the rods, receiving the first corner of the tube in the nip, holding one end of the rods near the corner and swinging the rods over the entire end and the opposite second corner, while additionally stretching the second resilient band on the second ends of the rods, and resiliently urging the rods together on the end of the tube with the bands intending to reduce the sides of the nip between the rods, and advancing the rods along the tube, while dispensing a product from the tube.

Other advantages and features of the invention will be apparent from the disclosure, which includes the above and ongoing specification with the claims and the drawings.

BRIEF DESCRIPTION OF THE DRAWING

FIG. 1 shows an overall view of the apparatus as it would appear without a tube dispenser between the rods.

FIG. 2 shows the apparatus with a slight gap between the rods, as occurs when a tube is inserted.

FIG. 3 is a side view of the apparatus with cylinder rods.

FIG. 4 is an isolated view of a band or 0-ring.

FIG. 5 is an isolated view of a rod with squared-off groves.

FIGS. 6–10 illustrate a variety of shapes for the rod ends.

FIGS. 11 and 12 illustrate two ways in which the 0-rings may rest in the grooves.

FIG. 13 points out the protruding portion of the rods.

FIGS. 14A–D give various views of the tube holding accessory.

FIGS. 15A–D illustrate various mounting means for the tube holding accessory.

FIGS. 23 and 24 show the tube squeezer being placed on the tube by starting at an end corner of the tube.

FIG. 25 shows a rod having smoothly curved grooves.

FIG. 26 shows the tube squeezer in use, being slid along the length of a tube dispenser.

FIG. 27 is an example of prior art, namely a fixed type tube squeezer.

FIG. 28A–D illustrate four possible shapes of 0-rings.

DETAILED DESCRIPTION OF THE DRAWINGS

Figure 16:
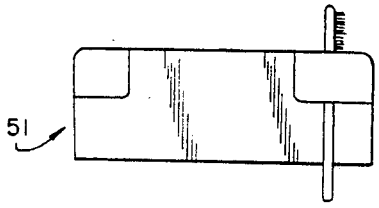
FIG. 16 shows the holding assembly incorporated into a toothbrush holder.

FIG. 1 gives a lengthwise view of the assembled apparatus. A cylindrical rod 3 is in contact with and parallel to an identical cylindrical rod 5. The rods are held in position by means of two bands or 0-rings 7, one at each end of the rod assembly. The 0-rings or bands fit into grooves 9 in the rod cylinders. When assembled as shown, the 0-rings or bands are somewhat stretched, creating tension within the 0-rings. The tensile force creates a reactionary compressive force, thereby maintaining the contact between the two cylinders.

FIG. 2 is a similar illustration, showing a lengthwise view of the assembled apparatus with rod 3 and rod 5 being in parallel but having a slight spacing 11 between them, as would occur when a tube is inserted between the rods. The two elastic 0-rings 7 stretch slightly to accommodate the tube thickness.

FIG. 3 is a side view of the apparatus with cylindrical rods. The depth of the grooves 9 is illustrated by the dashed circles. The 0-rings 7 are wrapped around the upper rod 3 and lower rod 5 and fit into the grooves.

FIG. 4 illustrates an 0-ring 7 as it would appear if removed from the rest of the apparatus.

The isolated view of a rod in FIG. 5 shows one possible shape for the grooves 15 and the rod ends 13. The grooves are squared off, and the rod ends are rounded. Since the rods in the apparatus are identical, a rod such as the one illustrated can be used for both the upper and lower rods when assembled.

FIG. 6 gives a closer view of rounded rod end 13.

FIG. 7 shows an alternative rod end 17 which is square.

FIG. 8 is a rod end with beveled edges 19.

FIG. 9 shows a primarily square rod end with slightly rounded corners 21.

FIG. 10 shows a rod end which comes to a point 23.

FIG. 11 shows that the 0-rings 7 may be entirely recessed within the grooves so that they do not protrude.

Alternatively, FIG. 12 illustrates that the 0-rings 7 may protrude somewhat from the groove.

FIG. 13 points out the protrusion 31 at either end of the apparatus. This protrusion becomes useful in conjunction with a holding device for the apparatus.

FIGS. 14A–D illustrate such a holding device.

The top view, 14A, shows primarily horizontal surfaces 33 on which the protrusions of the tube squeezer rest. A flat surface 35 is provided for mounting the accessory onto a wall or the like. Part of the flat surface 35 is used as one side of a wall 37 surrounding the resting surfaces 33. Two other sides of surface 33 are also enclosed by a small wall 39 and wall 41.

FIG. 14B is a top view of the accessory holding a tube squeezer and tube.

FIG. 14C is a front view of the accessory holding a tube squeezer and tube. The small front wall 41 and the mounting surface 35 are clearly illustrated.

FIG. 14D is an angled view of the accessory, providing a clear view of the overall shape.

FIGS. 15A–D illustrate various possible means for mounting the holding accessory.

FIG. 15A shows a side view of the holding accessory with a screw 43 used to hold the mounting wall 35 flush against a surface.

FIG. 15B is a side view of the holding accessory with a magnet 45 affixed to the back of the mounting wall 35. A permanent adhesive pad with a release sheet would appear identical to magnets 45.

FIG. 15C shows a hook 47 attached to the upper portion of the mounting surface 35 for hooking over a cup holder or a towel rack or any board, rail, lip or edge.

FIG. 15D shows another side view of the holding accessory, this time having a suction cup 49 attached to the mounting surface 35.

FIG. 16 illustrates that the holding accessory 51 may be combined with devices such as a toothbrush holder.

Figure 17A:
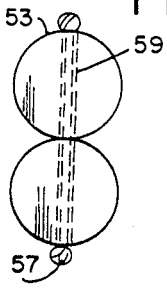
FIGS. 17A, B show alternatives to the 0-rings.

FIGS. 17A and B illustrate alternative designs of the structure, using components other than 0-rings.

FIG. 17A shows an elastic string 53 running through a hole 59 in both cylinders, and being anchored on each end by a small object 57 with slightly larger diameter than the hole.

Figure 17B:
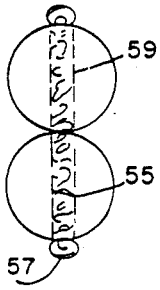

FIG. 17B shows a design similar to 17A. However, a spring 55 is run through the holes 59 in the rods and is anchored 57 by an enlargement, bead or washer.

Figure 18:
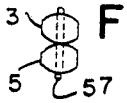
FIG. 18 is an end view of the rods, showing that they need not be cylindrical.

FIG. 18 is an end view of the apparatus as it would appear with non-cylindrical rods. The upper rod 3 is identical to the lower rod 5. The rods are attached by means of an elastic string or spring, and therefore the small anchors 57 are visible.

FIG. 19 shows still another possible shape 61 for the rods.

Figure 19A:
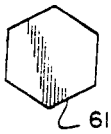
FIGS. 19A and B illustrate an octagonal rod design.

FIG. 19A shows a side view, illustrating a possible polygonal shape of the rods 63 and 65.

Figure 19B:
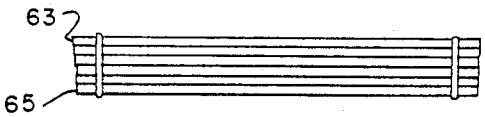

FIG. 19B shows the assembled apparatus using the polygonal rods.

Figure 20:
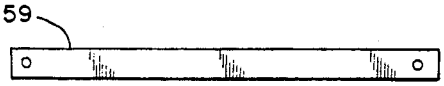
FIG. 20 shows holes in the rods of a plastic tube.

FIG. 20 is a top view of a rod, illustrating the holes 59 that would be necessary if the rods were used in conjunction with an elastic string or spring.

Figure 21:
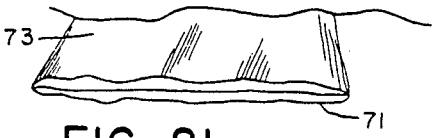
FIG. 21 is an end view of a tube.

FIG. 21 illustrates the end 71 of a tube 73 that has unfurled.

Figure 23:
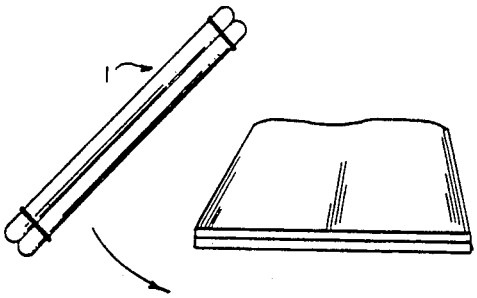
Figure 22:
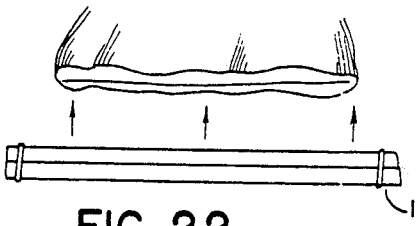
FIG. 22 shows a tube squeezer being placed on the tube by pushing directly against the uneven bottom edge of the tube.

FIG. 22 shows the tube squeezer 1 being applied directly onto the end of an unfurled tube. Often this method is difficult with an unfurled tube, and it is easier to start at a corner as illustrated in FIG. 23.

Once the apparatus is over one corner of the tube, it is then easier to place it in position round the end of the tube, as illustrated in FIG. 24.

FIG. 25 is another view of a single rod 3 illustrating smoother curved grooves 9.

FIG. 26 shows the apparatus 1 being used on a tube 71. The apparatus is inserted over the closed end of the tube, and is gradually slid along the tube length as the contents are dispensed.

FIG. 27 is an example of prior art. The tube squeezer 75 shown has a fixed slot gap width 77, making it difficult or impossible to accommodate a range of tube thicknesses.

FIGS. 28A–D provide cross-sections of variously shaped 0-rings.

The 0-ring 81 in FIG. 28A has a primarily square cross-section. The 0-ring is thick enough to protrude slightly from a groove in the rod.

FIG. 28B shows an 0-ring 83 with triangular cross-section. A point 85 of the triangle would sit in a groove cut to fit this particular ring.

FIG. 28C shows an 0-ring 7 with circular cross-section. Such an 0-ring would be used with grooves such as those illustrated in FIG. 25.

FIG. 28D shows a primarily thin rectangular cross-section of an 0-ring 87. The flat 0-ring would be entirely recessed within a groove.

While the invention has been described with reference to specific embodiments, modifications and variations of the invention may be constructed without departing from the scope of the invention, which is described in the following claims.

We claim:

1. A tube squeezer apparatus comprising first and second similar uniformly elongated rigid rods each having generally smooth surfaces for slidably moving on a tube and each having first and second opposite ends, each of the rods having first and second grooves respectively near the first and second ends directly on the surfaces of each of the rods, the first and second grooves of the second rod being spaced similarly to the first and second grooves in the first rod and first and second resilient means extending respectively between the first goooves and the second grooves, each of the first and second resilient means extending radially outward from the grooves and having a first portion for positioning in the respective grooves in the first rod and having a second portion for positioning in the respective first and second grooves in the second rod, a nip formed between adjacent longitudinal portions of the elongated rods whereby enlarging the nip by inserting an end of the tube in the nip tends to stretch the first and second resilient members, the stretching of the first and second resilient members tending to return the nip towards its original condition whereby a tube within the nip is squeezed.

2. The tube squeezer apparatus of claim 1 wherein the rods have rounded cross sections.

3. The tube squeezer apparatus of claim 1, wherein the rods have circular cross sections.

4. The tube squeezer apparatus of claim 1 wherein the rods have similar polygonal cross sections.

5. The apparatus of claim 1 further comprising a supporting means for the rods, the supporting means having a generally planar vertical mounting surface and first and second opposite inward facing spaced shelves projected horizontally outwardly from the mounting surface for receiving the first and second ends of the first and second rods thereon.

6. The tube squeezer apparatus of claim 5 further comprising lateral and frontal walls partially surrounding outer and forward edges of the shelves for preventing lateral and forward outward movement of the rods from the shelves.

7. The tube squeezer apparatus of claim 6 further comprising a tooth brush receiving opening in at least one of the shelves.

8. The tube squeezer apparatus of claim 6 wherein said mounting surface includes means extending rearwardly therefrom for mounting the mounting surface on a vertical surface, the mounting means selected from the group consisting of one of a mounting screw, a magnet, an adhexive tape, a hook and a suction cup.

9. The tube squeezer apparatus of claim 1 wherein the grooves are peripheral grooves and wherein the resilient means are band like resilient means having said first and second portions oppositely extending circumferentially beyond the rods and mounted in the peripheral grooves.

10. The tube squeezer apparatus of claim 9 wherein the peripheral grooves are directly formed in outer surfaces of the rods.

11. The tube squeezer apparatus of claim 10 wherein the peripheral grooves extend entirely around said ends of the rods.

12. The tube squeezer apparatus of claim 11 wherein the resilient means are first and second elastomeric O-rings which respectively engage the first and second peripheral grooves and extend outward around the first and second rods.

13. The tube squeezer apparatus of claim 11 wherein the resilient means are elastomeric rings.

14. The tube squeezer apparatus of claim 13 wherein the resilient elastomeric rings have circular-shaped cross sections.

15. The tube squeezer apparatus of claim 13 wherein the resilient elastomeric rings have square-shaped cross sections.

16. The tube squeezer apparatus of claim 13 wherein the resilient elastomeric rings have rectangular-shaped cross sections.

17. The tube squeezer apparatus of claim 13 wherein the resilient elastomeric rings have triangular-shaped cross sections.

18. A squeezing apparatus for effectively removing the contents of collapsible plastic tube or the like, comprising:

two substantially identical uniformly elongated rigid rods having generally smooth surfaces for slidably moving on the tube, a groove near each end of and directly in a surface of each of both rods extending about the perimeter of each rod and perpendicular to the lengthwise axis of the rod, two identical O-rings of elastic material that fit into the grooves and extend radially outward from each groove of both rods, holding the two rods in parallel and maintaining contact between the rods in the absence of an intervening object by means of elastic tension, and further maintaining in stationary relation with the rods in the presence of an intervening object by means of friction forces.

19. The squeezing apparatus of claim 18, wherein the O-ring are made of material having elastic properties sufficient to stretch somewhat when a tube is present between the two rods and having enough elastic tension to sufficiently press the rods together in order to squeeze material out of a tube.

20. The squeezing apparatus of claim 18, wherein the elastic material of the O-ring has a co-efficient of static friction to prohibit relative motion between the O-ring and a surface of each of the grooves contacting the O-rings when a tube is inserted between the rods.

21. The squeezing apparatus of claim 20, wherein the rods are made of a material having a co-efficient of static friction to prohibit relative motion between the rods and of each of the O-rings contacting the rods when a tube is inserted between the rods.

* * * * *